United States Patent [19]

Kubiatowicz

[11] 4,189,911

[45] Feb. 26, 1980

[54] TOY TIMING DEVICE

[75] Inventor: James F. Kubiatowicz, Minneapolis, Minn.

[73] Assignee: Custom Concepts Incorporated, Minneapolis, Minn.

[21] Appl. No.: 914,438

[22] Filed: Jun. 12, 1978

[51] Int. Cl.[2] ..... A63H 33/30

[52] U.S. Cl. ..... 58/106; 58/2

[58] Field of Search ..... 58/2, 1 R, 45, 53, 106, 58/116 R; 46/47, 59

[56] References Cited

U.S. PATENT DOCUMENTS

| | | | |
|---|---|---|---|
| 2,667,738 | 2/1954 | Eichholz | 58/106 |
| 2,919,538 | 1/1960 | Eichholz | 58/106 |
| 3,690,021 | 9/1972 | Glass et al. | 58/106 |

*Primary Examiner*—Vit W. Miska

*Attorney, Agent, or Firm*—William L. Huebsch

[57] ABSTRACT

A toy timing device including a rotor which can be manually moved from a stop to a start position on a housing and will move back to a stop position under the influence of biasing means which decreases in biasing force as the rotor moves toward its stop position. The housing has spaced projections which tension a rubber band in adjustable frictional engagement across a friction surface on the rotor. The friction surface on the rotor is generally parallel to its plane of movement except for a portion defined by a rib projecting along one edge of the surface that is shaped so that the frictional engagement of the rubber band on the rotor will decrease as the rotor moves to its stop position to produce rotor movement of a slow and generally constant velocity.

9 Claims, 6 Drawing Figures

TOY TIMING DEVICE

BACKGROUND OF THE INVENTION

This invention relates to mechanisms for regulating the speed of relative movement of members toward a position to which they are biased by means which decrease in biasing force as movement occurs, and in one aspect to such mechanisms used in toy timing devices.

Many such mechanisms are known. Most of such mechanisms, however, contain many moving parts and are too expensive for use in inexpensive toys such as are used as premiums in boxes of cereal. My U.S. patent application Ser. No. 806,855 describes a simple inexpensive mechanism in which lengths of a rubber band tensioned across ribs slip and stick along a continuous surface and provide an escapement-like mechanism to control the speed of relative movement of such members. While that mechanism produces a ticking-like sound which is desirable in a toy timing device, the speed control it provides is not as predictable or repeatable as is desired for such a toy.

SUMMARY OF THE INVENTION

The present invention provides a simple mechanism which may be used to regulate the speed of relative movement of members toward a stop position to which the members are biased by a means which decreases in biasing force as the members move, which mechanism produces more constant relative movement of the members than my previous design described in application Ser. No. 806,855 and is easily adjustable to provide a desired relative rate of travel for the members, while still being so inexpensive that it may be used in a toy included as a premium in a box of cereal.

According to the present invention there is provided a mechanism comprising a first member including spaced projections; a second member mounted on the first member to afford relative movement of the members between start and stop positions and having a friction surface that moves relative to and has portions between said projections during said relative movement; means for biasing the members toward their stop position with a force which decreases upon relative movement of the members from their start toward their stop position; and a length of elastic resilient material tensioned across and in engagement with the friction surface. The friction surface is generally in the plane of movement of the members except for a portion defined by a rib which projects normal to the direction of movement. There is relative movement between the projections and the rib during relative movement of the members, and the rib decreases generally uniformly in height from its portion between the projections in the start position along its portions that pass between the projections as the portions move to their stop position. The shape of the rib is adapted to decrease the frictional engagement between the length of elastic resilient material and the friction surface as the rotor moves toward its stop position to compensate for the decrease in biasing force and produce rotor movement of a slow and generally constant velocity.

In a preferred embodiment in which the mechanism is included in a toy timing device, the first member is a housing and the second member is a rotor mounted between the projections for rotation around a post on the housing, and the friction surface is circular with the rib being arcuate and projecting axially of the rotor along one edge of the friction surface. The length of elastic material is provided by a common rubber band (called the friction rubber band herein) which has been washed to remove any release agent and is tensioned between the projections across and in contact with the friction surface. The rotor may be manually moved relative to the housing to the start position of the rotor to set the timer, and includes a pointer positioned to move along a dial formed on the housing as the rotor moves toward the stop position of the rotor. The projections are shaped so that the ends of the friction rubber band may be shifted in position along them to vary the frictional force between the side of the friction rubber band and the friction surface, thereby affording regulation of the rotational speed of the rotor.

Also in the preferred embodiment the means for biasing the rotor to its stop position is provided by a second common rubber band (called the driving rubber band herein) tensioned between notches on opposite sides of the rotor, extending through a diametrical groove in the end of the post, stretched and wound partially around the post in the stop position of the rotor, and further stretched and wound around the post in the start position of the rotor.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
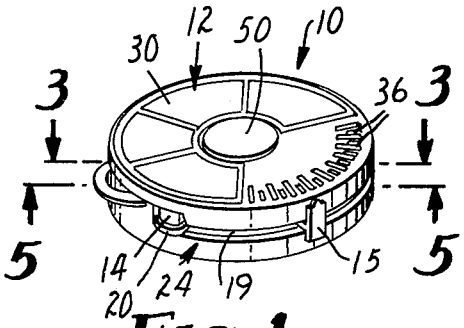
FIG. 1 is a perspective view of a timing toy including a mechanism according to the present invention.

Referring now to the drawing there is shown a toy timing device including a mechanism according to the present invention generally designated by the numeral 10.

Figure 3:
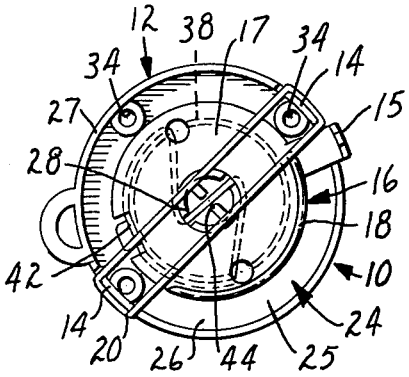
FIG. 3 is a sectional view taken approximately along lines 3—3 of FIG. 1 showing a rotor in the toy in its stop position.

The device 10 comprises a first member or housing 12 including spaced projections 14; a second member or rotor 16 mounted in the housing 12 to afford relative movement of the members 12 and 16 between a relative start position (FIG. 4) and a relative stop position (FIG. 3) which positions are established by engagement of a projecting indicating member or pointer 15 on the rotor 16 with the ends of a slot 19 for the pointer 15 defined by the housing 12; and means for biasing the members 13 and 16 to their stop position with a force which decreases upon movement of the members 12 and 16 from their start toward their stop positions. Relative movement between the members 12 and 16 could be provided by movement of either of the members 12 or 16 with the other held stationary, but in this embodiment is normally provided by movement of the rotor 16 between corresponding start and stop positions relative to the housing 12 and will be explained in that relationship for ease of understanding.

The rotor 16 defines a friction surface 17 including a planar portion generally parallel to the plane of movement of the rotor 16 and a ribbed portion or rib 18 projecting above the planar portion in a direction normal to the direction of relative movement between the members 12 and 16 and along one edge of the rotor 16 so that the rib 18 moves longitudinally through the space between the projections 14 during relative movement of the members 12 and 16. The rib 18 decreases generally uniformly in height between its portion which is between the projections 14 when the rotor 16 is in its start position and its portions which pass between the projections 14 as the rotor 16 moves toward its stop position, and merges with the planar portion of the friction surface 17 in the general area of the friction surface 17 that is between the projections 14 when the rotor 16 is in its stop position. A length of resiliently elastic material (provided by parallel portions of a washed common rubber band 20 called a friction rubber band 20 herein) is stretched around the projections 14 and across and in contact along its side with the friction surface 17. The friction rubber band 20 will rub along and bridge between the distal surface of the rib 18 and the opposite edge of the friction surface 17 when a portion of the rib 18 is between the projections 14 (FIG. 4), and will rub along the entire width of the friction surface 17 as its rib portion 18 merges with its planar portion. Decreasing friction between the friction rubber band 20 and the friction surface 17 caused by the decreasing height and merging of the rib 18 will compensate for the decreasing biasing force, causing the speed of movement of the rotor 16 from its start to its stop position to be both slow and generally constant. The rib 18 is radiused along its outer edge and the edge of the rotor 16 opposite the rib 18 is beveled to facilitate smooth sliding movement of the friction rubber band 20 along the friction surface 17.

The housing 12 is a two piece assembly comprising a base piece 24 including a circular wall 25 with a planar annular inner surface 26, a generally cylindrical rim 27 projecting from the periphery of the wall 25 (portions of which between spaced slots provide the projections 14), and a cylindrical post 28 coaxial with the wall and rim 26 and projecting from the surface 26, about which post 28 the rotor 16 is rotatably mounted. The housing 12 also includes a circular cover piece 30 having three spaced projections 32 frictionally engaging openings 34 (FIG. 2) in the rim 27 to retain the cover piece 30 coaxial with the base piece 24. The cover piece 30 has spaced markings 36 molded in its outer surface along the slot 19 to provide a dial along which the pointer 15 travels as the rotor 16 moves between its start and stop positions.

The rotor 16 includes a generally circular portion with a central opening through which the post 28 is positioned; the pointer 15 which projects from one edge of the circular portion through the slot 19; the arcuate rib 18 which projects axially of the post 28 and rotor 16 generally in the same direction as the projections 14 and which with the adjacent surface of the circular portion defines the friction surface 17; and an annular collar 38 coaxial with the projecting axially from the side of the circular portion opposite the rib 18 with its distal edge providing a bearing surface for the rotor 16 which slides along the annular surface 26.

The means for biasing the rotor 16 toward its second position comprises two diametrically opposed notches 40 in the collar 38, and a second common rubber band 42 (called the driving rubber band 42 herein) which extends around a portion of the collar 38 and through the two opposed notches 40 with its central part between the notches 40 extending through a transverse diametrically extending groove 44 in the distal end part of the post 28 and with its parts adjacent its central part partially wrapped around the periphery of the post 28. The parts wrapped around the post 28 become more fully wrapped as the rotor 16 is moved from its stop position (FIG. 3) toward its start position (FIG. 4) which stretches and further tensions the driving rubber band 42 to bias the rotor toward its stop position with increased force.

The timing toy 10 also includes means for regulating the contact force between the friction rubber band 20 and the friction surface 17 of the rotor 16, thereby regulating the rapidity of movement of the rotor 16 toward its stop position. This means is provided by the smooth outer surfaces of the projections 14 which project axially of the rotor 16 and allow the ends of the friction rubber band 20 around the projections 14 to be shifted along their outer surfaces to increase or decrease the pressure between the friction rubber band 20 and the friction surface 17 of the rotor 16. Both ends of the friction rubber band 20 may be shifted either toward or away from the rotor 16 to correspondingly generally decrease or increase the speed of movement of the rotor 16 from its start to its stop position, while one of the ends may be adjusted to make the speed of movement more constant between the start and stop positions of the rotor; with movement of the end of the friction rubber band 20 which the pointer is adjacent when the rotor 16 is in its start position providing the most regulation of the first half of such movement and movement of its other end providing the most regulation of the last half of such movement.

The desired stretching of the friction rubber band 20 is provided by sizing the projections 14, the spacing between the projections 14, the friction surface 17 including the rib 18, and the friction rubber band 20 relative to each other. A rotor 16 having a rib 18 1/16 inch wide, a 1 9/32 inch outside diameter and a 5/64 inch change in height axially of the rotor 16, projections 14 9/32 inch wide and spaced at $1\frac{3}{4}$ inch between their outside surfaces have been found suitable for use with a washed standard size No. 8 rubber band which is about 1/16 inch wide and has a length (measured when its side portions are pressed together) of about $\frac{7}{8}$ inch.

Assembly and Operation

Figure 2:
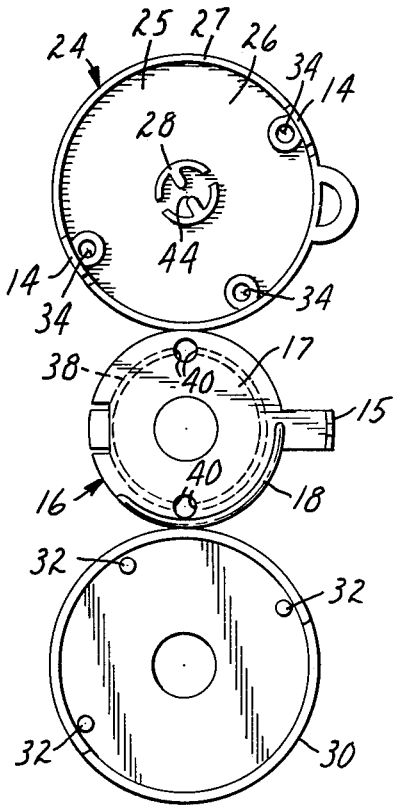
FIG. 2 is a plan view of a molding providing three of the parts of the timing toy of FIG. 1.
Figure 4:
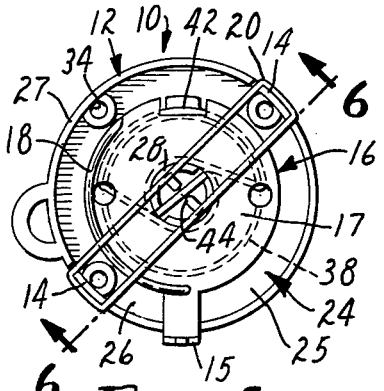
FIG. 4 is a sectional view taken approximately along lines 3—3 of FIG. 1 but shown with the rotor close to its start position.
Figure 6:
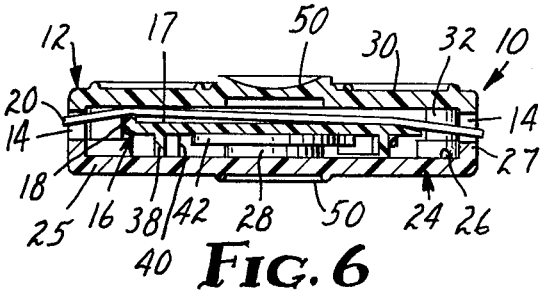
FIG. 6 is a sectional view taken approximately along lines 6—6 of FIG. 4.
Figure 5:
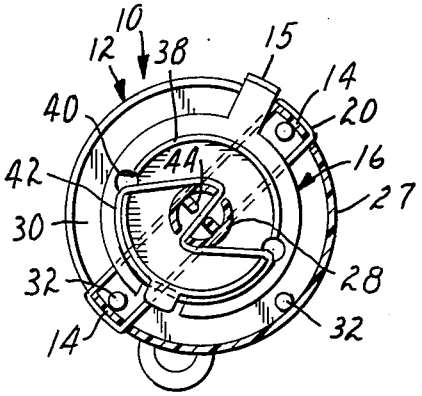
FIG. 5 is a sectional view taken approximately along lines 5—5 of FIG. 1.

As is seen in FIG. 2 the housing pieces 24 and 30 and the rotor 16 may be molded in one piece of a polymeric material such as high impact styrene. To assemble the device 10, the housing pieces 24 and 30 and the rotor 16 are separated and the driving rubber band 42 is stretched around a part of the collar 38 of the rotor and through the notches 40 in the collar 38 of the rotor 16 so that a portion of the driving rubber band 20 extends diametrically across the central opening in the rotor 16. The part of the driving rubber band crossing the opening in the rotor 16 is then positioned in the groove 44 in the post 28 with the pointer 15 projecting away from the part of the slot 19 defined on the base piece 24. The rotor 16 is then rotated about 90 degrees to position the pointer 15 in the part of the slot 19 defined on the base piece 24, thereby partially wrapping the driving rubber band 42 about the post 28 (FIG. 4). The friction rubber band 20 is then tensioned around the projections 14 over the rotor 16 so that the side of two portions of the friction rubber band 20 contact the friction surface 17, and the cover piece 30 is pressed into position by pressing the projections 32 into the mating openings 34. Thereafter, when the pointer 17 is manually moved to its start position and released, the parts of the friction rubber band 20 crossing the friction surface 17 will rub along the friction surface 17 regulating the speed of movement of the rotor 16 back to its stop position at a slow generally constant rate. If it is desired to change or regulate the speed of movement of the rotor 16, one or both of the portions of the friction rubber band 20 around the projections 14 can be shifted axially of the projections 14 to produce the desired effect. If it is desired to temporarily stop movement of the rotor 16 between its start and stop positions, this can be done by pressing together and resiliently deflecting the housing pieces 24 and 30 at their centers to pinch the rotor 16 therebetween, such deflecting of the housing pieces 24 and 30 being facilitated by cup-like projections 50 adapted to receive the tips of the fingers centered on the outer surfaces of the housing pieces 24 and 30.

The pattern of movement of the rotor 16 has been found to be reasonably repeatable. The mechanism can be adjusted to produce times of about 20 seconds for the rotor 16 to rotate about 100 degrees so that the mechanism provides a suitable action for devices such as the toy timing device 10. Also the mechanism would be suitable for use in other toys and games where regulated relative movement of parts is desired.

I claim:

1. A mechanism comprising a first member having spaced projections, a second member mounted on the first member to afford relative movement of the members between start and stop positions and having a friction surface that moves relative to and has portions between said projections during said relative movement, means for biasing the members toward their stop position with a force which decreases upon relative movement of the members from their start toward their stop position, and a length of elastic resilient material tensioned between said projections across and in engagement along one side with said friction surface, said friction surface being generally in the plane of movement of said members except for a portion defined by a rib which projects normal to the direction of movement and decreases generally uniformly in height from a portion between the projections in the start position of the members along portions which pass between the projections as the members move toward their stop position to decrease the frictional engagement between the frictional surface and the elastic material and provide a slow and generally constant relative velocity for the members.

2. A mechanism according to claim 1 wherein said second member is rotatably mounted on said first member between said projections, said friction surface is generally circular, and said rib is arcuate and projects axially of said second member along one edge of said friction surface.

3. A mechanism according to claim 1 or claim 2 wherein said length of elastic resilient material is a washed annular rubber band tensioned between said projections.

4. A mechanism according to claim 3 wherein said first member includes a post having a diametrically extending groove in its distal end, said second member is rotatably mounted about said post and said mechanism includes a second rubber band including a portion extending between diametrically opposed positions on said second member, having a part in said groove, and parts adjacent said groove partially wrapped around said post to provide said means for biasing said members toward said stop position.

5. A mechanism according to claim 3 wherein said projections have outer surfaces shaped and oriented to afford movement of the ends of the rubber band along the projections to change the force of engagement between the side of the rubber band and said friction surface.

6. A toy timing device comprising a housing having spaced projections, a rotor rotatably mounted on said housing between said projections for movement between start and stop positions relative to said housing, having an indicating member adapted to move along a portion of said housing, and a generally circular frictional surface generally in the plane of movement of said rotor except for a portion defined by a rib projecting normal to said plane of movement along one edge of said frictional surface and decreasing generally uniformly in height between a portion between said projections in said start position and portions which move between said projections as said rotor moves toward said stop position, means for biasing the rotor toward its stop position with a force which decreases upon movement of said rotor from its start toward its stop position, and a length of elastic resilient material tensioned between said projections across and in engagement along one side with said friction surface so that the decreasing height of said rib will decrease frictional engagement between the frictional surface and elastic member to compensate for the decreasing biasing means and provide a slow and generally constant velocity of the rotor as its moves from its start toward its stop position.

7. A toy timing device according to claim 6 wherein said length of elastic resilient material is a washed annular rubber band tensioned between said projections.

8. A toy timing device according to claim 6 wherein said housing includes a post having a diametrically extending groove in its distal end, said rotor is rotatably mounted about said post, and said toy timing device includes a second rubber band including a portion extending between diametrically opposed positions on said rotor, having a part in said groove, and parts adjacent said groove partially wrapped around said post to provide said means for biasing said rotor toward said stop position.

9. A toy timing device according to claim 6 wherein said projections have outer surfaces shaped and oriented to afford movement of the ends of the rubber band along the projections to change the force of engagement between the side of the rubber band and said friction surface.

* * * * *